US010509362B1

(12) United States Patent
Shokai

(10) Patent No.: US 10,509,362 B1
(45) Date of Patent: Dec. 17, 2019

(54) ELECTRIC APPARATUS THAT DETERMINES TYPE OF ATTACHMENT UNIT AND PERFORMS OPERATIONS USING THE ATTACHMENT UNIT

(71) Applicant: TOSHIBA TEC KABUSHIKI KAISHA, Tokyo (JP)

(72) Inventor: Takeharu Shokai, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/267,598

(22) Filed: Feb. 5, 2019

(30) Foreign Application Priority Data

Jul. 2, 2018 (JP) ..... 2018-126171

(51) Int. Cl.
*G03G 21/18* (2006.01)
*G03G 15/08* (2006.01)

(52) U.S. Cl.
CPC ..... *G03G 21/1892* (2013.01); *G03G 15/0863* (2013.01); *G03G 15/0865* (2013.01); *G03G 2215/0697* (2013.01); *G03G 2221/1823* (2013.01)

(58) Field of Classification Search
CPC ..... G03G 15/0863; G03G 21/1875; G03G 21/1878; G03G 21/1882; G03G 21/1889; G03G 21/1892; G03G 2215/0695; G03G 2215/0697; G03G 2221/1823
See application file for complete search history.

(56) References Cited

U.S. PATENT DOCUMENTS

| | | | | |
|---|---|---|---|---|
| 6,711,362 | B2 | 3/2004 | Asakura | |
| 7,333,738 | B2 | 2/2008 | Nasu | |
| 8,873,976 | B2 | 10/2014 | Suzuki | |
| 9,386,172 | B2 | 7/2016 | Kishida | |
| 2005/0254837 | A1* | 11/2005 | Takahashi | G03G 15/50 399/12 |
| 2010/0290791 | A1* | 11/2010 | Sonoda | G03G 15/55 399/12 |
| 2013/0089343 | A1* | 4/2013 | Nishimura | G03G 15/0863 399/12 |
| 2014/0233967 | A1* | 8/2014 | Suzuki | G03G 15/502 399/12 |

* cited by examiner

*Primary Examiner* — Thomas S Giampaolo, II
(74) *Attorney, Agent, or Firm* — Kim & Stewart LLP

(57) ABSTRACT

An electronic apparatus includes an attachment mechanism to which an attachment unit is detachably attachable and a processor. The processor is configured to perform a determination operation to determine whether or not an attachment unit attached to the attachment mechanism is of a specific type, and transmit a determination result of the determination operation.

11 Claims, 4 Drawing Sheets

ELECTRIC APPARATUS THAT DETERMINES TYPE OF ATTACHMENT UNIT AND PERFORMS OPERATIONS USING THE ATTACHMENT UNIT

CROSS-REFERENCE TO RELATED APPLICATION

This application is based upon and claims the benefit of priority from Japanese Patent Application No. 2018-126171, filed on Jul. 2, 2018, the entire contents of which are incorporated herein by reference.

FIELD

Embodiments described herein relate generally to an electric apparatus in which one of plural types of units can be attached.

BACKGROUND

In an image forming apparatus of an electrophotographic system, toner can be replenished by replacing a toner cartridge. There is a so-called genuine toner cartridge (or more generally "genuine product"), which is manufactured by a manufacturer of the image forming apparatus or a manufacturer relating thereto and has performance characteristics that match characteristics of the image forming apparatus. There is also a so-called non-genuine toner cartridge (or more generally "non-genuine product"), which is provided by a third party or the like.

The genuine product and the non-genuine product often have different performance characteristics. An image forming apparatus of one type determines whether the genuine product or the non-genuine product is attached, and performs a different image forming control to achieve a better print quality. This image forming apparatus starts processing for the attached toner cartridge after determining whether or not the attached toner cartridge is the genuine product. This processing to determine whether or not the toner cartridge is the genuine product is a large burden for a processor.

In addition, there may be plural types of genuine products, and when plural types of toner cartridges are selectively attached despite whether it is the genuine product or the non-genuine product, the same problem as described above may occur.

If plural types of attachment units are attachable to an electric apparatus, the same problem as described above may occur in the electric apparatus, whether the electric apparatus is or is not an image forming apparatus.

For the above reasons, it is desirable to suppress an influence of the processing to determine the type of an attachment unit on a control of an operation performed by using the attachment unit.

DETAILED DESCRIPTION

According to an embodiment, an electronic apparatus includes an attachment mechanism to which an attachment unit is detachably attachable and a processor. The processor is configured to perform a determination operation to determine whether or not an attachment unit attached to the attachment mechanism is of a specific type, and transmit a determination result of the determination operation.

An embodiment is described below with reference to the accompanying drawings. In the present embodiment, as an example of an electric apparatus, an image forming apparatus, more particularly, a digital multi-function peripheral including a printer is described. In the following description, the digital multi-function peripheral is abbreviated as an MFP (multi-function peripheral).

Figure 1:
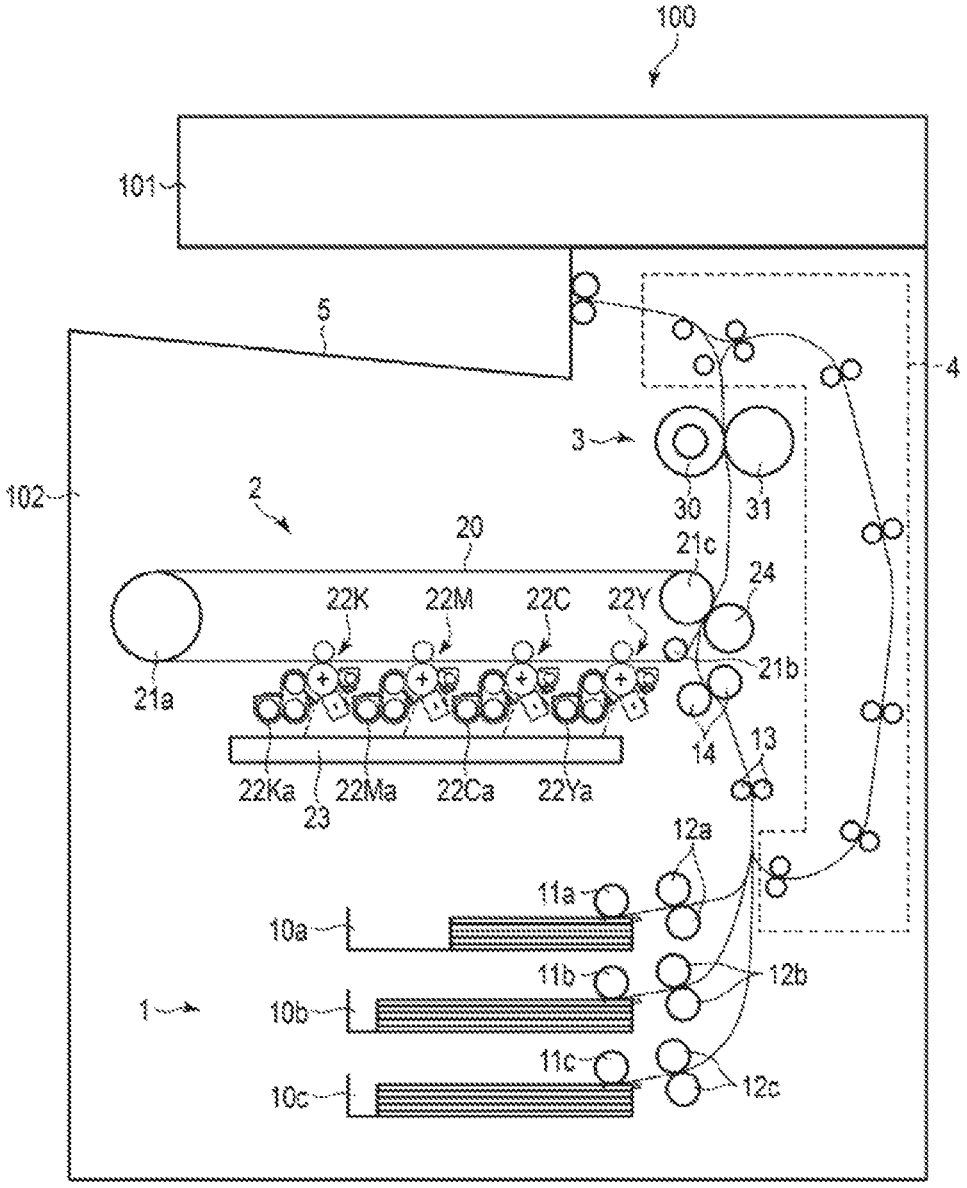
FIG. 1 is a diagram schematically illustrating a configuration of an MFP according to an embodiment.

FIG. 1 is a diagram schematically illustrating a configuration of an MFP 100 according to the present embodiment.

As shown in FIG. 1, the MFP 100 includes a scanner 101 and a printer 102.

The scanner 101 reads an image on a document to generate image data corresponding to the image. The scanner 101 uses an image sensor to generate image data corresponding to a reflected light image from a reading surface of the document. The scanner 101 scans the document placed on a document table with an image sensor that moves along the document. Alternatively, the scanner 101 may scan a document conveyed by an automatic document feeder with a fixed image sensor. The scanner 101 may use both of the above-described two types of scanning methods, or may use another scanning method.

The printer 102 forms an image on a sheet using an electrophotographic system. The printer 102 has a color printing function of printing a color image on the sheet and a monochrome printing function of printing a monochrome image on the sheet. The printer 102 forms a color image by superimposing element images respectively using, for example, toners of three colors including yellow, cyan, and magenta, or toners of four colors including black, yellow, cyan, and magenta. The printer 102 forms the monochrome image using the black toner, for example.

In the example of a configuration shown in FIG. 1, the printer 102 includes a sheet feed unit 1, a print engine 2, a fixing section 3, an automatic double-sided device 4, and a sheet discharge tray 5. The automatic double-sided device is abbreviated as an ADU (automatic double-sided unit) in the following description.

The sheet feed unit 1 includes sheet feed cassettes 10*a*, 10*b*, and 10*c*, pickup rollers 11*a*, 11*b*, and 11*c*, conveyance rollers 12*a*, 12*b*, and 12*c*, a conveyance roller 13, and a registration roller 14.

The sheet feed cassettes 10*a*, 10*b*, and 10*c* accommodate sheets of respective types in a stacked manner. Here, a sheet is used, but the material thereof is not necessarily a paper, and may be resin or the like. The sheet feed unit 1 may further include a manual feed tray.

The pickup rollers 11*a*, 11*b*, and 11*c* pick up sheets one by one from the sheet feed cassettes 10*a*, 10*b*, and 10*c*, respectively. The pickup rollers 11*a*, 11*b*, and 11*c* feed the sheet taken out to the conveyance rollers 12*a*, 12*b*, and 12*c*, respectively.

The conveyance rollers 12*a*, 12*b*, and 12*c* feed the sheet fed from the pickup rollers 11*a*, 11*b*, and 11*c* to the conveyance roller 13 via a conveyance path formed by a guide member (not shown) and the like.

The conveyance roller 13 further conveys the sheet fed from any one of the conveyance rollers 12*a*, 12*b*, and 12*c* to the registration roller 14.

The registration roller 14 corrects inclination of the sheet and adjusts a feeding timing of the sheet to the print engine 2.

The number of sets composed of the sheet feed cassette, the pickup roller and the conveyance roller is not limited to three, and may be any natural number. If a manual feed tray is provided, only a pickup roller and a conveyance roller paired with the manual feed tray are provided, and neither sheet feed cassette nor the pickup roller and the conveyance roller paired therewith may be provided.

The print engine 2 includes a belt 20, support rollers 21*a*, 21*b*, and 21*c*, image forming units 22K, 22M, 22C, and 22Y, an exposure unit 23, and a transfer roller 24.

The belt 20 is an endless belt and is supported by the support rollers 21*a*, 21*b*, and 21*c* to maintain the state shown in FIG. 1. The belt 20 rotates counterclockwise in FIG. 1 as the support roller 21*a* rotates. The belt 20 temporarily carries an image to be formed on a sheet.

Each of the image forming units 22K, 22M, 22C, and 22Y includes a photoconductive drum, a charger, a developing device, a transfer roller, and a cleaner, and has a known structure for forming an image by an electrophotographic system through cooperation with the exposure unit 23. The image forming units 22K, 22M, 22C, and 22Y include toner cartridges 22Ka, 22Ma, 22Ca, and 22Ya in a detachable manner, respectively. The toner cartridges 22Ka, 22Ma, 22Ca, and 22Ya respectively accommodate black toner, magenta toner, cyan toner and yellow toner. The image forming units 22K, 22M, 22C, and 22Y are arranged along the belt 20 in such a manner that axial directions of the respective photoconductive drums thereof are parallel to each other. The image forming unit 22K forms an element image using the black toner supplied from the toner cartridge 22Ka. The image forming unit 22M forms an element image using the magenta toner supplied from the toner cartridge 22Ma. The image forming unit 22C forms an element image using the cyan toner supplied from the toner cartridge 22Ca. The image forming unit 22Y forms an element image using the yellow toner supplied from the toner cartridge 22Ya. The image forming units 22K, 22M, 22C, and 22Y form element images for respective colors on the belt 20 in an overlapped manner. As a result, the image forming units 22K, 22M, 22C, and 22Y form a color image obtained by superimposing the black, magenta, cyan and yellow element images on the belt at a time point at which the sheet passes through the image forming unit 22Y. By operating only the image forming unit 22K, a monochrome image can also be formed.

The exposure unit 23 includes four laser scanners respectively corresponding to the image forming units 22K, 22M, 22C, and 22Y therein. The exposure unit 23 exposes the respective photoconductive drums of the image forming units 22K, 22M, 22C, and 22Y with laser beam according to image data representing element images for respective colors. The scanning direction of the laser scanner is parallel to the axial direction of the photoconductive drum. Therefore, a depth direction in FIG. 1 is a main scanning direction, and a lateral direction is a sub-scanning direction.

The transfer roller 24 is parallel to the support roller 21*c*, and sandwiches the belt 20 between the transfer roller and the support roller 21*c*. The transfer roller 24 sandwiches the sheet fed from the registration roller 14 between the transfer roller 24 and the belt 20. The transfer roller 24 electrostatically transfers the image formed on the belt 20 to the sheet.

Thus, the print engine 2 forms an image on the sheet fed by the registration roller 14 according to the electrophotographic system.

The fixing section 3 includes a fixing roller 30 and a pressure roller 31.

The fixing roller 30 is formed of a hollow metal roller covered with a heat-resistant resin, for example, and includes a heater in the hollow region. The heater is, for example, a halogen lamp, but any other type of heater may be suitably used. The fixing roller 30 melts the toner adhering to the sheet fed from the print engine 2 to fix the toner to the sheet.

The pressure roller 31 is parallel to the fixing roller 30 and is pressed against the fixing roller 30. The pressure roller 31 sandwiches the sheet fed from the print engine 2 with the fixing roller 30 while pressing the sheet against the fixing roller 30.

The ADU 4 includes a plurality of rollers and selectively performs the following two operations. In a first operation, the sheet passing through the fixing section 3 is fed towards the discharge tray 5 without any change. The first operation is performed when single-sided printing or double-sided printing is completed. In a second operation, the sheet passing through the fixing section 3 is conveyed to the side of the discharge tray 5 temporarily, switched back, and then fed to the print engine 2. The second operation is performed when formation of an image on one surface in double-sided printing is completed.

The discharge tray 5 receives the discharged sheet on which the image is formed.

Next, the configuration of the control system of the MFP 100 is described.

Figure 2:
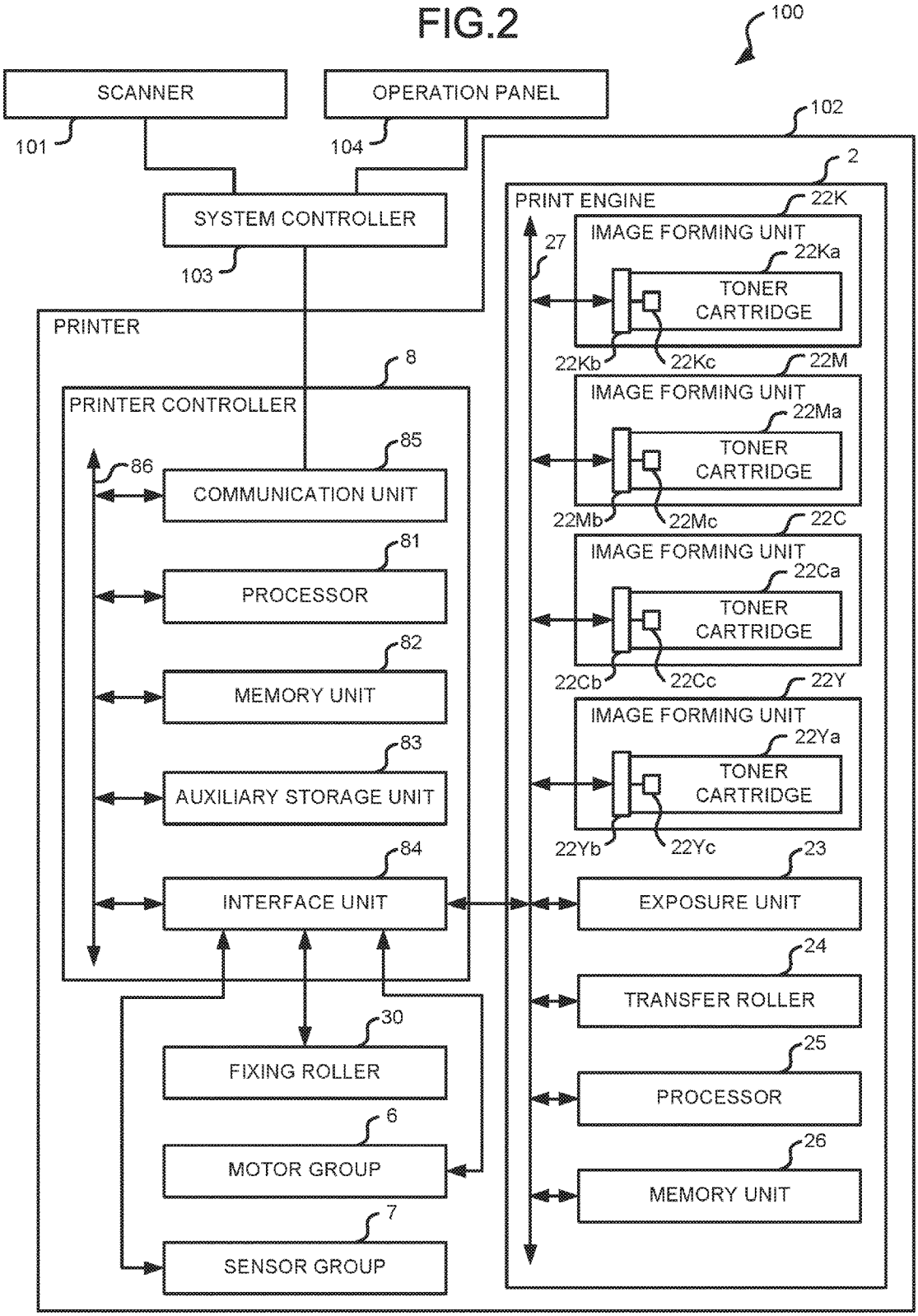
FIG. 2 is a block diagram schematically illustrating a circuit configuration of main portions of a control system of the MFP shown in FIG. 1.

FIG. 2 is a block diagram schematically illustrating a circuit configuration of main portions of a control system of the MFP 100. In FIG. 2, the same components as those shown in FIG. 1 are denoted with the same reference numerals, and the detailed description thereof is omitted.

In addition to the scanner 101 and the printer 102, the MFP 100 further includes a system controller 103 and an operation panel 104.

The system controller 103 collectively controls components of the digital multi-function peripheral 100 to perform an expected operation of the digital multi-function peripheral 100. The expected operation of the digital multi-function peripheral 100 is, for example, an operation for performing various functions of an existing digital multi-function peripheral.

The operation panel 104 includes an input device and a display device. The operation panel 104 inputs an instruction from an operator using the input device. The operation panel 104 displays various kinds of information to be provided to the operator using the display device. As the operation panel 104, for example, a touch panel can be used.

The printer 102 includes a motor group 6, a sensor group 7, and a printer controller 8 in addition to the above-described components.

The motor group 6 includes a plurality of motors for rotating the pickup rollers 11*a*, 11*b*, and 11*c*, the conveyance rollers 12*a*, 12*b*, and 12*c*, the conveyance roller 13, the registration roller 14, the support roller 21*a*, the transfer roller 24, the fixing roller 30, the photoconductive drums and various rollers of image forming units 22K, 22M, 22C, and 22Y, and rollers included in the ADU 4.

The sensor group 7 includes various sensors for detecting the state of the MFP 100. The sensor group 7 includes at least a cover sensor for detecting an open or closed state of a cover opened and closed at the time of replacing the toner cartridge described below. The sensor group 7 may include sensors the same as those provided in other existing MFPs.

Under the control of the system controller 103, the printer controller 8 collectively controls components of the printer 102 to perform an expected operation of the printer 102. The printer controller 8 includes a processor 81, a memory unit 82, an auxiliary storage unit 83, an interface unit 84, a communication unit 85, and a transmission line 86.

The processor 81, the memory unit 82, and the auxiliary storage unit 83 are connected via the transmission line 86 and serve as a computer that executes information processing for performing the above-described control.

The processor 81 acts as a central functional module of the above-described computer. The processor 81 executes any information processing by executing information processing programs such as an operating system, middleware, and application programs stored in the memory unit 82 or the auxiliary storage unit 83.

The memory unit 82 acts as main storage of the above-described computer. The memory unit 82 includes a nonvolatile memory area and a volatile memory area. The memory unit 82 stores the above-described information processing programs in the nonvolatile memory area. The memory unit 82 may store data necessary for the processor 81 to execute processing for controlling components of the computer in the nonvolatile or volatile memory area. The memory unit 82 uses the volatile memory area as a work area where data is appropriately rewritten by the processor 81.

The auxiliary storage unit 83 acts as auxiliary storage of the above-described computer. The auxiliary storage unit 83 is, for example, an EEPROM (electric erasable programmable read-only memory), an HDD (hard disc drive), an SSD (solid state drive), or the like. The auxiliary storage unit 83 stores data used for the processor 81 to perform various kinds of processing or data generated in processing performed by the processor 81. The auxiliary storage unit 83 may store the above-described information processing programs.

The transmission line 86, the print engine 2, the motor group 6, and the fixing roller 30 are connected to the interface unit 84. The interface unit 84 is used to transmit or receive information and signals between respective connected parts.

The communication unit 85 enables transmission and reception of the information between the processor 81 and the system controller 103 by communicating with the system controller 103 under the control of the processor 81.

The transmission line 86 includes an address bus, a data bus, a control signal line and the like, and transmits data and control signals transmitted and received between the connected parts.

In addition to the components shown in FIG. 1, the print engine 2 includes a processor 25, a memory unit 26, and a transmission line 27. The image forming units 22K, 22M, 22C, and 22Y further include attachment/detachment mechanisms 22Kb, 22Mb, 22Cb, and 22Yb, respectively.

With the attachment/detachment mechanisms 22Kb, 22Mb, 22Cb, and 22Yb, the toner cartridges 22Ka, 22Ma, 22Ca, and 22Ya are physically and electrically attachable and detachable to and from the image forming units 22K, 22M, 22C, and 22Y, respectively.

Security chips 22Kc, 22Mc, 22Cc, and 22Yc are storage devices attached to the toner cartridges 22Ka, 22Ma, 22Ca, and 22Ya, respectively. The security chips 22Kc, 22Mc, 22Cc, and 22Yc store security data encrypted using a predetermined encryption key. When the toner cartridges 22Ka, 22Ma, 22Ca, and 22Ya to which the security chips 22Kc, 22Mc, 22Cc, and 22Yc are attached, respectively, are attached to the attachment/detachment mechanisms 22Kb, 22Mb, 22Cb, and 22Yb, respectively, the security chips 22Kc, 22Mc, 22Cc, and 22Yc are electronically connected to the transmission line 27. The security chips 22Kc, 22Mc, 22Cc, and 22Yc output the stored security data described above to the transmission line 27. However, chips for outputting data different from the above-described security data may be attached to the toner cartridges 22Ka, 22Ma, 22Ca, and 22Ya, or the security chips 22Kc, 22Mc, 22Cc, and 22Yc may not be attached to the toner cartridges 22Ka, 22Ma, 22Ca, and 22Ya.

The processor 25 and the memory unit 26 are connected to each other via the transmission line 27 to function as a computer that executes information processing for determining whether or not the toner cartridges 22Ka, 22Ma, 22Ca, and 22Ya attached to the attachment/detachment mechanisms 22Kb, 22Mb, 22Cb, and 22Yb, respectively, are genuine products.

The processor 25 acts as a central functional module of the computer. The processor 25 executes any information processing by executing information processing programs stored in the memory unit 26.

The memory unit 26 acts as main memory of the above-described computer. The memory unit 26 includes a nonvolatile memory area and a volatile memory area. The memory unit 26 stores the information processing programs for executing the above-described information processing in the nonvolatile memory area. The memory unit 26 may store data necessary for the processor 25 to execute the above-described information processing in the nonvolatile or volatile memory area. The memory unit 26 uses the volatile memory area as a work area where data is appropriately rewritten by the processor 25.

The transmission line 27 includes an address bus, a data bus, a control signal line, and the like, and transmits data and control signals transmitted and received between the connected parts.

Next, the operation performed by the MFP 100 configured as described above is described. The operation performed by the MFP 100 is different from that of other existing MFPs in that an operation of determining whether or not each of the image forming units 22K, 22M, 22C, and 22Y is a genuine product and performing different operations for forming an image depending on the determination result. Therefore, in the following description, the point is mainly explained. Accordingly, the MFP 100 can perform various operations performed by other existing MFPs, which are not described here.

The image forming units 22K, 22M, 22C, and 22Y consume the toner accommodated in the attached toner cartridges 22Ka, 22Ma, 22Ca, and 22Ya, respectively, while an image forming operation is performed. The one that having small remaining amount of the toner among the toner cartridges 22Ka, 22Ma, 22Ca, and 22Ya is removed from the image forming units 22K, 22M, 22C, and 22Y by a replacement worker. Then, another toner cartridge corresponding to the same color as that of the removed toner cartridge is attached to the corresponding image forming unit by the replacement worker.

When such a replacement work is performed, the cover provided on a housing of the MFP 100 is opened by the replacement worker. When the replacement operation is terminated, the above-described cover is closed by the replacement worker. If it is detected by a cover sensor included in the sensor group 7 that the cover is closed in this manner, and an interrupt is generated correspondingly, the processor 81 starts the information processing shown in FIG. 3. The replacement work may be performed when the MFP 100 is in a power off state. In this case, the processor 81 cannot start the information processing shown in FIG. 3 in response to the closing of the cover. Therefore, the processor 81 starts the information processing shown in FIG. 3 after the MFP is started in response to a power-on state.

Figure 3:
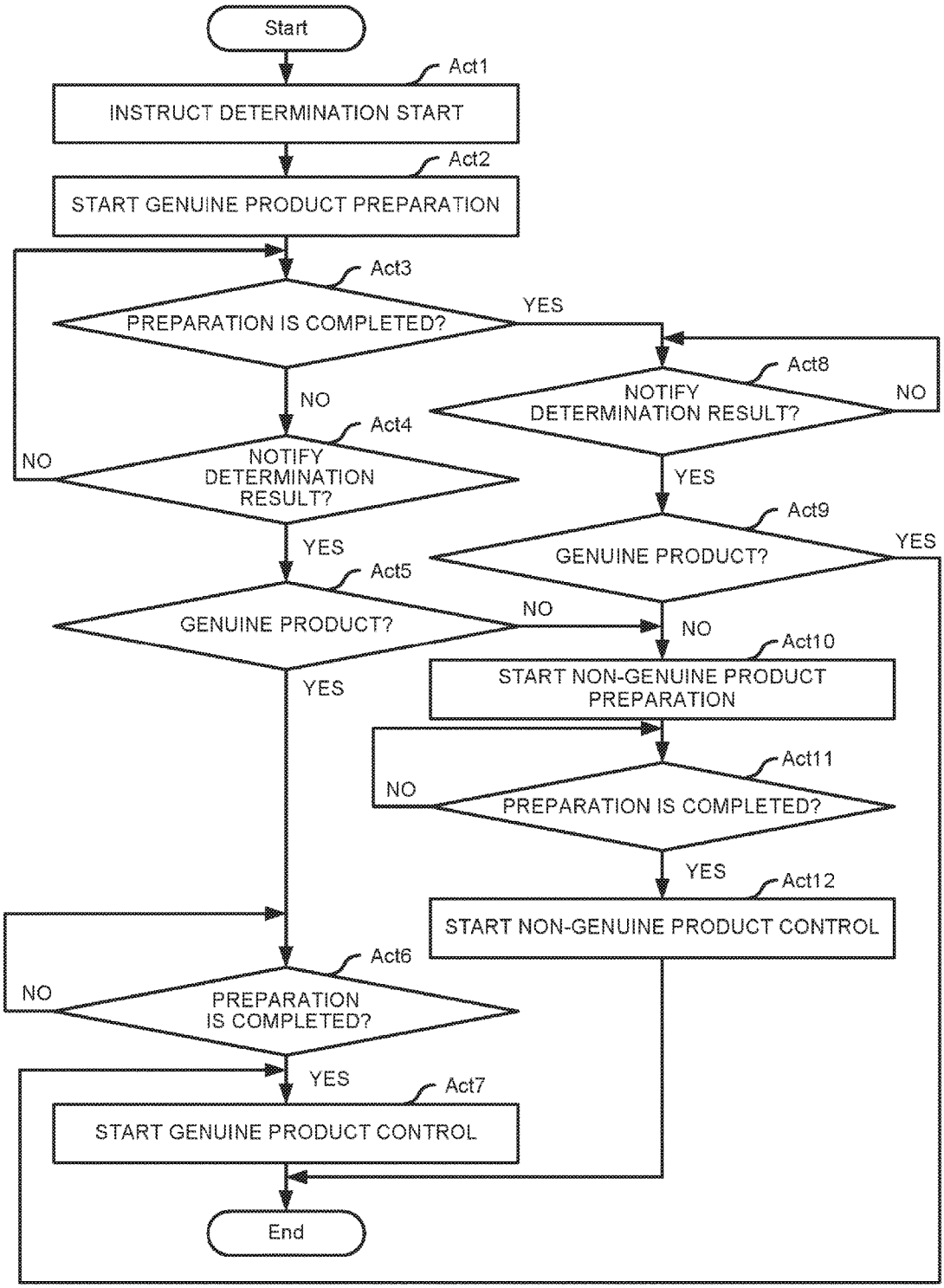
FIG. 3 is a flowchart depicting information processing performed by a processor of a printer controller in FIG. 2 relating to a control for enabling execution of printing by the MFP shown in FIG. 1 and FIG. 2.

FIG. 3 is a flowchart depicting information processing performed by the processor 81 relating to a control for enabling printing by the MFP 100. The processor 81 performs the following information processing by executing the information processing program stored in the memory unit 82 or the auxiliary storage unit 83. The content of the processing described below is merely an example, and it is possible to appropriately change an order of a part of the processing, omit a part of the processing or add another processing.

In Act 1, the processor 81 instructs the processor 25 to start determining whether or not the toner cartridges 22Ka, 22Ma, 22Ca, and 22Ya are genuine products. Specifically, the processor 81 issues a predetermined command for this instruction to the print engine 2 via the interface unit 84. If the above-described command is transmitted to the processor 25 via the transmission line 27, the processor 25 of the print engine 2 receives the command. Then, the processor 25 starts the information processing shown in FIG. 4 in response to the command.

Figure 4:
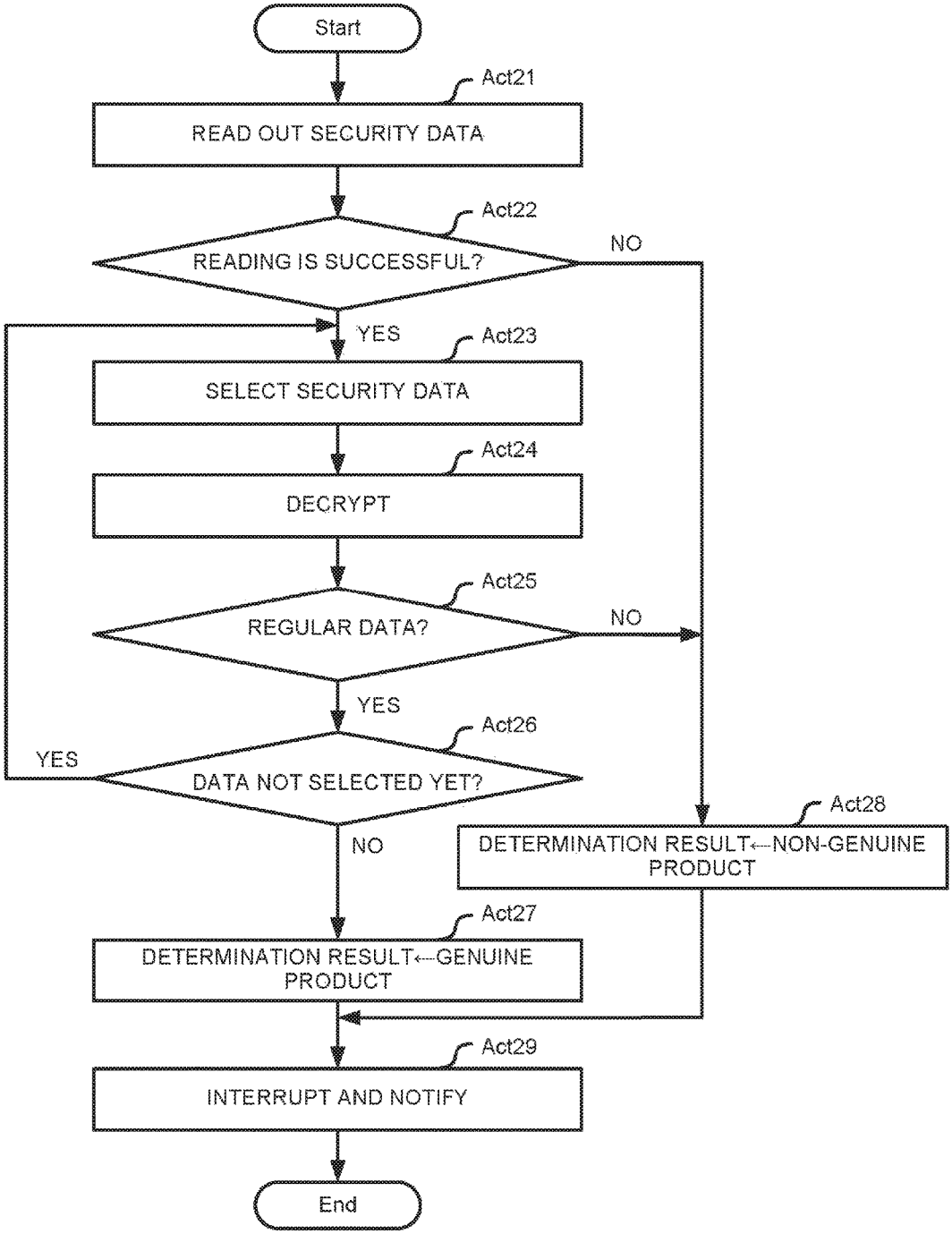
FIG. 4 is a flowchart depicting information processing performed by a processor provided in a print engine in FIG. 2.

FIG. 4 is a flowchart depicting information processing performed by the processor 25. The processor 25 performs the following information processing by executing the information processing program stored in the memory unit 26. The content of the processing described below is merely an example, and it is possible to appropriately change the order of a part of the processing, omit a part of the processing or add another processing.

In Act 21, the processor 25 reads the security data from the toner cartridges 22Ka, 22Ma, 22Ca, and 22Ya respectively attached to the image forming units 22K, 22M, 22C, and 22Y. If the toner cartridges 22Ka, 22Ma, 22Ca, and 22Ya are provided with the security chips 22Kc, 22Mc, 22Cc, and 22Yc, respectively, the processor 25 can read the security data from the security chips 22Kc, 22Mc, 22Cc, and 22Yc, respectively. Then, the processor 25 stores the read security data in the memory unit 26, the memory unit 82 or the auxiliary storage unit 83. The processor 25 cannot read the security data of the toner cartridge 22Ka, 22Ma, 22Ca, or 22Ya if there is a toner cartridge that does not include the security chip 22Kc, 22Mc, 22Cc, or 22Yc among the toner cartridges 22Ka, 22Ma, 22Ca, and 22Ya. Even if the security chip is provided, if the security chip cannot normally output the security data, the processor 25 cannot read the security data relating to the toner cartridge provided with that security chip.

In Act 22, the processor 25 determines whether or not the security data is successfully read out for all of the toner cartridges 22Ka, 22Ma, 22Ca, and 22Ya. The processor 25 determines Yes if succeeding, and the process proceeds to Act 23.

In Act 23, the processor 25 selects one of the security data stored in the memory unit 26, the memory unit 82 or the auxiliary storage unit 83 as described above.

In Act 24, the processor 25 decrypts the selected security data using a predetermined key.

In Act 25, the processor 25 determines whether or not the data obtained by decryption is predetermined regular data. Then, if the regular data is obtained by decryption, the processor 25 determines Yes and the process proceeds to Act 26.

In Act 26, the processor 25 determines whether or not there is security data which has not yet been selected in Act 23 among the security data read in Act 21. Then, the processor 25 determines Yes if there is the security data that has not yet been selected, and the process returns to Act 23. In this case, the processor 25 again executes the processing in Act 23 to select the security data different from the security data already selected in Act 23. Thus, the processor 25 performs the processing in Act 24 and Act 25 sequentially on each of the security data read in Act 21. Then, if the regular data can be obtained for all the security data, the processor 25 determines Yes in Act 25 and determines No in Act 26, and then the process proceeds to Act 27.

In Act 27, the processor 25 determines the determination result as "genuine product".

On the other hand, if the reading of the security data fails even for one of the toner cartridges 22Ka, 22Ma, 22Ca, and 22Ya, the processor 25 determines No in Act 22 and the process proceeds to Act 28. If the regular data cannot be obtained by decryption of any one of the read security data, the processor 25 determines No in Act 25, and the process proceeds to Act 28. In other words, if the security data obtained by encrypting the regular data using the predetermined key is not acquired from any one of the toner cartridges 22Ka, 22Ma, 22Ca, and 22Ya, the process proceeds to Act 28. In Act 28, the processor 25 determines the determination result as "non-genuine product".

If the determination result in Act 27 or Act 28 is determined, the process proceeds to Act 29.

In Act 29, the processor 25 interrupts the processor 81 to notify the determination result. Then, after the notification is completed, the processor 25 terminates the information processing shown in FIG. 4.

As described above, the processor 25 determines whether or not the toner cartridges 22Ka, 22Ma, 22Ca, and 22Ya attached to the attachment/detachment mechanisms 22Kb, 22Mb, 22Cb, and 22Yb, respectively, are "genuine products" or "non-genuine products" by executing the information processing shown in FIG. 4. The processor 25 notifies the determination result to the processor 81 as a predetermined notification destination. Thus, the processor 25 executes the information processing by executing the information processing program, and in this way, the processor 25 functions as a determination processor.

After instructing the start of the determination in Act in FIG. 3, the processor 81 continues the processing subsequent to Act 2 in parallel with the execution of the information processing by the processor 25.

In Act 2, the processor 81 starts a genuine product preparation. The genuine product preparation refers to a preparation for performing printing using the toner cartridges 22Ka, 22Ma, 22Ca, and 22Ya which are genuine products, and a common preparation despite whether or not the toner cartridges 22Ka, 22Ma, 22Ca, and 22Ya are genuine products. The type of the processing to be performed as the genuine product preparation may be arbitrarily determined, for example, by a designer of the MFP 100. The processing to be performed as the genuine product preparation may be as follows, for example.

A surface temperature of the fixing roller 30 is adjusted to a proper temperature for fusing the toner which is the genuine product to fix the toner. The proper temperature is selected from a plurality of predetermined values according to environmental conditions such as temperature and humidity in the printer 102.

A developing bias used in the developing devices respectively included in the image forming units 22K, 22M, 22C, and 22Y is adjusted to a proper bias value suitable for developing using the toner which is the genuine product. The proper bias value is selected from a plurality of predetermined values according to the environmental conditions such as the temperature and humidity in the printer 102.

A transfer bias to be applied to the transfer roller 24 is adjusted to a proper bias value suitable for transferring the image formed by using the toner which is the genuine product on the belt 20 onto the sheet. The proper bias value is selected according to the environmental conditions such as the temperature and humidity in the printer 102 and the type of the sheet.

Processing for starting toner remaining amount management using the toner cartridge which is the genuine product and has a function of detecting the toner remaining amount.

Calibration of the scanner 101.

The processor 81 executes the genuine product preparation as other information processing in parallel with the information processing shown in FIG. 3. Then, in the information processing shown in FIG. 3, the process proceeds to Act 3.

In Act 3, the processor 81 determines whether or not the genuine product preparation started as described above is completed. Then, if it is not completed, the processor 81 determines No, and the process proceeds to Act 4.

In Act 4, the processor 81 determines whether or not the determination result from the processor 25 is notified. Then, if the determination result is not notified, the processor 81 determines No, and the process returns to Act 3.

Thus, the processor 81 stands by until the genuine product preparation is completed in Act 3 or the determination result is notified in Act 4. Then, if an interrupt from the processor 25 as described above occurs and the determination result is notified, the processor 81 determines Yes in Act 4 and the process proceeds to Act 5.

In Act 5, the processor 81 determines whether or not the notified determination result is the "genuine product". If the "genuine product" is notified as the determination result, the processor 81 determines Yes, and the process proceeds to Act 6.

In Act 6, the processor 81 stands by until the genuine product preparation is completed. Then, the processor 81 determines Yes if all the genuine product preparation is completed, and the process proceeds to Act 7.

In Act 7, the processor 81 starts a genuine product control. The genuine product control refers to a control of each component for performing printing using the toner cartridges 22Ka, 22Ma, 22Ca, and 22Ya which are the genuine products. The type of processing to be performed as the genuine product control may be arbitrarily determined, for example, by the designer of the MFP 100. The processing to be performed as the genuine product control may be as follows, for example.

The surface temperature of the fixing roller 30 is maintained at a proper temperature.

The developing bias used in the developing devices respectively included in the image forming units 22K, 22M, 22C and 22Y is maintained at a proper bias value.

The transfer bias applied to the transfer roller 24 is maintained at a proper bias value.

Processing for the toner remaining amount management using the toner cartridge which is the genuine product and has the function of detecting the toner remaining amount.

Adjustment of color and density etc. of each element image to reproduce proper color and density using the toner which is the genuine product.

The processor 81 executes the genuine product control as information processing different from the information processing shown in FIG. 3. Then, the processor 81 terminates the information processing shown in FIG. 3.

On the other hand, if the genuine product preparation is completed earlier than the notification of the determination result in the standby state of Act 3 and Act 4, the processor 81 determines Yes in Act 3, and the process proceeds to Act 8.

In Act 8, the processor 81 stands by until the determination result is notified from the processor 25. Then, if the interrupt from the processor 25 occurs as described above and the determination result is notified, the processor 81 determines Yes and the process proceeds to Act 9.

In Act 9, the processor 81 determines whether or not the notified determination result is "genuine product". Then, if "genuine product" is notified as the determination result, the processor 81 determines Yes. Then, the process proceeds to Act 7, and the processor 81 starts the genuine product control in the same manner as described above.

On the other hand, if the "non-genuine product" is notified as the determination result, the processor 81 determines No in ACT 9 and the process proceeds to Act 10. If the determination result notified in the standby state of Act 3 and Act 4 is the "non-genuine product", the processor 81 determines No in Act 5 and the process proceeds to Act 10.

In Act 10, the processor 81 starts a non-genuine product preparation. The non-genuine product preparation refers to a preparation for performing printing using the toner cartridges 22Ka, 22Ma, 22Ca, and 22Ya which are non-genuine products and a common preparation despite whether the toner cartridges 22Ka, 22Ma, 22Ca, and 22Ya are the genuine products. The type of processing to be performed as the non-genuine product preparation may be arbitrarily determined, for example, by the designer of the MFP 100. The processing to be performed as the non-genuine product preparation may be as follows, for example.

The surface temperature of the fixing roller 30 is adjusted to a standard temperature determined without considering the characteristics of the toner.

The developing bias used for the developing devices respectively included in the image forming units 22K, 22M, 22C and 22Y is adjusted to a standard level determined without considering the characteristics of the toner.

The transfer bias to be applied to the transfer roller is adjusted to a standard level determined without considering the characteristics of the toner.

Calibration of the scanner 101.

The non-genuine product preparation is carried out in a form of taking over the genuine product preparation already started. In other words, each operation is performed to adjust a difference between the state already adjusted by the genuine product preparation and the target state in the non-genuine product preparation.

The processor 81 executes the non-genuine product preparation as information processing different from the information processing shown in FIG. 3. The process then proceeds to Act 11.

In Act 11, the processor 81 stands by until the non-genuine product preparation is completed. Then, if all non-genuine product preparation is completed, the processor 81 determines Yes and proceeds to the processing in Act 12.

In Act 12, the processor 81 starts the non-genuine product control. The non-genuine product control refers to a control of each component for performing printing using the toner cartridges 22Ka, 22Ma, 22Ca, and 22Ya which are the non-genuine products. The type of processing to be performed as the non-genuine product control may be arbitrarily determined, for example, by the designer of the MFP 100. The processing to be performed as the non-genuine product control may be set as follows, for example.

- The surface temperature of the fixing roller 30 is maintained at a standard temperature determined without considering the characteristics of the toner.
- The developing bias used in the developing devices respectively included in the image forming units 22K, 22M, 22C and 22Y is maintained at a standard level determined without considering the characteristics of the toner.
- The transfer bias applied to the transfer roller 24 is maintained at a standard level determined without considering the characteristics of the toner.
- Adjustment of color and density etc. of each element image to reproduce standard color and density determined without considering the characteristics of the toner.

The processor 81 executes the non-genuine product control as information processing different from the information processing shown in FIG. 3. Then, the processor 81 terminates the information processing shown in FIG. 3.

As described above, the genuine product control and the non-genuine product control are different control processing depending on whether the "genuine product" or the "non-genuine product" is determined as the determination result. Thus, the processor 81 executes the information processing by executing the information processing program, and in this way, the processor 81 functions as the control processor.

As described above, whether the toner cartridges 22Ka, 22Ma, 22Ca, and 22Ya attached to the image forming units 22K, 22M, 22C, and 22Y, respectively, are the genuine products is determined by executing the information processing by the processor 25. Then, the determination result is notified from the processor 25 to the processor 81 which is the predetermined notification destination. Therefore, for example, at the notification destination such as the processor 81 or the like, there is no burden caused by the processing for the above-described determination, and the processing load at the notification destination can be reduced.

In particular, if the encrypted security data is decrypted, the processing load becomes large. Therefore, since it is not necessary to perform such processing at the notification destination such as the processor 81 or the like, the processing load at the notification destination can be greatly reduced.

While the processor 25 performs the above-described determination, the processor 81, which is the above-described notification destination, performs a common preparation regardless of the determination result. Therefore, as compared with the case in which the processor 81 performs the preparation after receiving the notification of the determination result, it is possible to shorten the time until the printing can be started.

While the processor 25 performs the above-described determination, the processor 81 first executes the preparation corresponding to the case in which the determination result is the "genuine product". Therefore, as long as the genuine products are attached as the toner cartridges 22Ka, 22Ma, 22Ca, and 22Ya, it is possible to further shorten the time until the printing can be started.

In the present embodiment, the following various modifications can be carried out.

Although the types of the toner cartridges 22Ka, 22Ma, 22Ca, and 22Ya are divided into two types including the genuine product and the non-genuine product, it is also possible to divide the type of the genuine product into plural types, divide the type of the non-genuine product into plural types, or divide the types of the toner cartridges 22Ka, 22Ma, 22Ca, and 22Ya into more types. The number of toner cartridges of which types are determined may be any number other than 4. Specifically, for example, in the case of a monochrome MFP, when only one toner cartridge is used, the type of the only one of these cartridges may be determined.

The object of which type is determined is not limited to the toner cartridge, but may be a unit which is a different component of the printer 102, such as a photoconductive drum.

As long as a detachable unit is used, the present invention may also be applied to a printer incorporated in a device other than the MFP or in an independent printer. The printing system is not limited to the electrophotographic system, and any printing system such as an inkjet system, a thermal transfer system, an impact dot system, or the like may be used. In this case, instead of the toner cartridge, an ink cartridge or an ink ribbon cartridge may be the detachable unit. Furthermore, as long as the detachable unit is used, the present invention may also be applied to any electric apparatus other than the printer. Therefore, the object of which type is determined is not limited to a unit which is the component of the printer.

The notification destination of the determination result from the processor 25 is not limited to the processor 81, and may be any unit as long as it can perform processing upon receiving the notification.

After receiving the notification of the determination result from the processor 25, the processor 81 may start the genuine product preparation or the non-genuine product preparation based on the determination result. Also in this case, the processing common to the genuine product preparation or the non-genuine product preparation may be started before receiving the notification of the determination result.

The processor 25 may determine whether or not each of the toner cartridges 22Ka, 22Ma, 22Ca, and 22Ya is a genuine product, and notify the processor 81 of the determination result. In this case, the processor 81 may make a part of preparation such as adjustment of the developing bias different according to the determination result for each of the toner cartridges 22Ka, 22Ma, 22Ca, and 22Ya.

The MFP 100 according to the present embodiment may enter a sleep state if a predetermined time elapses since the termination of a printing job, cut off the heating of the fixing device (power supply to the fixing device), and turn off the power supply to the processor 81. Even if the power supply to the processor 81 is turned off in this way, since the power is supplied to the processor 25, as long as a main power supply of the MFP 100 is not turned off, the genuine/non-genuine (regular/irregular) product determination of the cartridge by the processor 25 is enabled, and the determination can be performed even if the non-genuine (irregular) cartridge is inserted during the sleep state.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

an attachment mechanism to which an attachment unit is detachably attachable;

a first processor configured to perform a determination operation to determine whether or not an attachment unit attached to the attachment mechanism is of a genuine type, and transmit a determination result of the determination operation; and a second processor configured to:

send a command to the first processor to start the determination operation;

upon sending the command, start a first print preparation associated with the genuine type, the first print preparation including a first setting of a toner fixing temperature;

perform a printing operation using a print setting made through the first print preparation when the determination result indicates that the attachment unit attached to the attachment mechanism is of the genuine type; and perform a second print preparation that includes a second setting of the toner fixing temperature different from the first setting and perform a printing operation using a print setting made through the second print preparation when the determination result indicates that the attachment unit attached to the attachment mechanism is not of the genuine type.

2. The image forming apparatus according to claim 1, wherein the second processor carries out at least part of the first print preparation while the first processor performs the determination operation.

3. The image forming apparatus according to claim 1, wherein the second processor terminates the first print preparation and performs the second print preparation when the second processor receives the determination result indicating that the attachment unit attached to the attachment mechanism is not of the genuine type during the first print preparation.

4. The image forming apparatus according to claim 1, wherein the first print preparation includes a first setting of a toner development bias, and the second print preparation includes a second setting of the toner development bias different from the first setting.

5. The image forming apparatus according to claim 1, wherein the first print preparation includes a first setting of a toner transfer bias, and the second print preparation includes a second setting of the toner transfer bias different from the first setting.

6. The image forming apparatus according to claim 1, wherein the attachment unit includes a toner cartridge.

7. The image forming apparatus according to claim 1, wherein during the determination operation, the first processor operates to read security data from a memory device included in the attachment unit attached to the attachment mechanism and determine whether or not the attachment unit attached to the attachment mechanism is of the genuine type based on a reading result.

8. The image forming apparatus according to claim 7, wherein the first processor operates to decrypt the security data when the security data are read from the memory device and determines whether or not the attachment unit attached to the attachment mechanism is of the genuine type based on a decrypting result.

9. An image forming method comprising:

sending a command to a processor to start a determination operation to determine whether or not an attachment unit attached to an attachment mechanism of an image forming apparatus is of a genuine type;

upon sending the command, starting a first print preparation associated with the genuine type, the first print preparation including a first setting of a toner fixing temperature;

receiving a determination result of the determination operation from the processor;

performing a printing operation using a print setting made through the first print preparation when the determination result indicates that the attachment unit attached to the attachment mechanism is of the genuine type; and performing a second print preparation that includes a second setting of the toner fixing temperature different from the first setting and performing a printing operation using a print setting made through the second print preparation when the determination result indicates that the attachment unit attached to the attachment mechanism is not of the genuine type.

10. The image forming method according to claim 9, wherein at least part of the first print preparation is carried out with a second processor different from the processor while the determination operation is performed.

11. The image forming method according to claim 9, wherein the attachment unit includes a toner cartridge.

* * * * *